US007625857B2

(12) United States Patent
Ward et al.

(10) Patent No.: US 7,625,857 B2
(45) Date of Patent: Dec. 1, 2009

(54) FABRIC CARE COMPOSITIONS COMPRISING CATIONIC STARCH

(75) Inventors: Alice Marie Ward, Middletown, OH (US); Yonas Gizaw, Cincinnati, OH (US)

(73) Assignee: The Procter & Gamble Company, Cincinnati, OH (US)

( * ) Notice: Subject to any disclaimer, the term of this patent is extended or adjusted under 35 U.S.C. 154(b) by 119 days.

(21) Appl. No.: 11/712,173

(22) Filed: Feb. 28, 2007

(65) Prior Publication Data

US 2007/0219111 A1 Sep. 20, 2007

Related U.S. Application Data

(60) Provisional application No. 60/777,447, filed on Feb. 28, 2006.

(51) Int. Cl.
*C11D 3/37* (2006.01)

(52) U.S. Cl. ..... 510/474

(58) Field of Classification Search ..... 510/474
See application file for complete search history.

(56) References Cited

U.S. PATENT DOCUMENTS

| | | | | |
|---|---|---|---|---|
| 6,797,688 | B2 | 9/2004 | Cooper et al. | |
| 7,135,451 | B2 * | 11/2006 | Corona et al. | 510/527 |
| 2004/0204337 | A1 | 10/2004 | Corona et al. | |

FOREIGN PATENT DOCUMENTS

| | | |
|---|---|---|
| EP | 596580 | 5/1994 |
| WO | WO 94/20597 | 9/1994 |
| WO | WO 01/46361 A1 * | 6/2001 |

* cited by examiner

*Primary Examiner*—John R Hardee
(74) *Attorney, Agent, or Firm*—David V. Upite; Mark A. Charles; Nicole M. Tepe

(57) ABSTRACT

Compositions comprising cationic high amylose starch are effective for use in fabric care compositions.

16 Claims, No Drawings

FABRIC CARE COMPOSITIONS COMPRISING CATIONIC STARCH

CROSS REFERENCE TO RELATED APPLICATION

This application claims priority to U.S. application Ser. No. 60/777,447, filed Feb. 28, 2006.

FIELD OF INVENTION

The present invention relates to compositions comprising cationic starch and its use in fabric care compositions.

BACKGROUND OF THE INVENTION

Cationic starch in fabric care compositions has been reported. See e.g., EP 596,580; WO 94/20597; U.S. Pat. No. 6,797,688; and US 2004/0204337 A1. However, there continues to be a need to develop a fabric care composition that provides improved fabric feel and/or softening, while maximizing cationic starch and/or fabric softening active fabric deposition efficiency.

SUMMARY OF THE INVENTION

The present invention attempts to address this need by a providing, in a first aspect of the invention, a fabric care composition comprising a cationic starch, wherein the cationic starch comprises from 51 % to about 95% amylose content by weight of the cationic starch; and wherein cationic starch comprises an average molecular weight of from 3,000,000 to about 60,000,000 Daltons.

The invention also provides methods of using the aforementioned composition in a rinse cycle of an automatic washing machine to soften fabric. A kit comprising the compositions is also provided.

The invention also provides a method of making a fabric care composition comprising the step of heating, preferably steam heating, a source of starch from about from about 300° C. to about 380° C., preferably heating the source of starch while under pressure from about 80 psi to about 100 psi, and preferably comprising the step of adding the heat-treated starch to a composition comprising a fabric softening active (such as a quaternary ammonium compound) that is at a temperature from about 85° C. to 95° C.

Kits and methods comprising the compositions of the present invention are also provided.

DETAILED DESCRIPTION OF THE INVENTION

The present invention is based upon the surprising discovery that the cationic high amylose starch of the present invention provides increased deposition to fabric surface, based on weight added to the composition, as well as increased softener active deposition, resulting in improved softening performance and improved fabric feel properties.

A first aspect of the invention provides for a composition comprising a cationic high amylose starch. The term "high amylose starch" is used herein in the broadest sense to include those starches with an amylose content of about 51-95% amylose polymer, by weight of the starch. In one embodiment, the cationic high amylose starch comprises from about 55% to about 80% amylose polymer, alternatively from about 65% to about 75%, by weight of the starch. In one embodiment, the cationic high amylose starch comprises from about 49% to about 5% amylopectin, alternatively from about 45% to about 20% amylopectin, alternatively from about 35% to about 25% amylopectin, by weight of the starch.

A suitable technique for measuring percentages of amylose, by weight of starch, include the methods described by the following: "Determination of Amylose in Cereal and Non-Cereal Starches by a Colorimetric Assay: Collaborative Study", Christina Martinez and Jaques Prodolliet, Starch, 48 (1996), pp. 81-85; and "An Improved Colorimetric Procedure for Determining Apparent and Total Amylose in Cereal and Other Starches," William R. Morrison and Bernard Laignelet, Journal Of Cereal Science, 1 (1983).

Another aspect of the invention provides a cationic high amylose starch comprising amylose and/or amylopectin (hereinafter "starch components") at a particular average molecular weight range from about 3,000,000 to about 60,000,000 Daltons. In one embodiment, the starch components comprise an average molecular weight from at least 1,000,000, alternatively at least about 2,000,000, alternatively at least about 3,000,000, alternatively at least about 4,000,000, alternatively at least 5,000,000, alternatively at least 8,000,000, alternatively at least 11,000,000, alternatively at least about 15,000,000, alternatively at least about 20,000,000, alternatively at least about 25,000,000, alternatively at least about 30,000,000, alternatively at least about 35,000,000 Daltons. In another embodiment, the starch components comprise an average molecular weight less than less than about 90,000,000, alternatively less than 60,000,000, alternatively less than about 55,000,000, alternatively less than about 50,000,000, alternatively less than about 45,000,000, alternatively less than about 40,000,000 Daltons. In one embodiment, the starch components comprise an average molecular weight of from about 11,000,000 to about 60,000,000 Daltons.

The "average molecular weight" of starch can be measured by any art-accepted method. One method includes the gel permeation chromatography ("GPC") method described in U.S. Pub. No. 2003/0154883 A1, paragraphs 123-127.

Another method of measuring the average molecular weight starch is one using the "Static Light Scattering Technique" as herein follows: Due to difficulty in fully solubilizing starch in water, solutions are made in dimethylsulfoxide (DMSO). Light scattering experiments measure the intensity as a function of angle and concentration, along with refractive index of DMSO, from which a Zimm Plot (x-axis~angle, y-axis~scattered intensity) can be generated according to the following equation:

$$\frac{Kc}{Rq}\left[1+\frac{q^2R^2g}{3}\right]\left[\frac{1}{m}+2A_2c\right]$$

where, 'Rq' is the Rayleigh ratio as a function of angle, 'K' represents optical constants for this system such as refractive indices, 'c' is concentration, 'q' is the scattering vector which changes as a function of angle, 'Rg' is the radius of gyration, 'M' is the molecular weight, and '$A_2$' is the second virial coefficient. By extrapolating to c=0 and q=0, molecular weight, radius of gyration can be determined.

DMSO is purchased from Aldrich (Lot#71K00431).

Polymer weights of 250 mg ±4 mg are placed into 100 ml glass vials. To these vials, 50 ml of DMSO is added using a 50 ml volumetric pipette. A small stir bar is added to the vial. Samples are heated to 80° C. for 20 minutes in an oven, then are stirred at 900 rotations per minute for 10 minutes, and then are placed back in the oven. This process of heating and stirring is repeated until complete solubility if the starch sample is achieved. There is significant solubility differences between samples, that later correlating with molecular weight. The light scattering instrumentation used is a Brookhaven BI-200SM goniometer capable of 10 to 155 degree measurements, with a BI-9000AT auto-correlator card with detection from a photomultiplier tube. The laser source is a Coherent FReD Argon laser (Serial #0001) operating at a wavelength of 514 nm. Dn/Dc (the change in refractive index as a function of polymer concentration) measurements are conducted using a BI-DN/DC instrument operating at a wavelength of 535 nm. There is minimal Dn/Dc variation with a change in wavelength this small (~20 nm). From this stock solution of 5.0 mg/ml, nine dilutions are made with DMSO at 0.5 mg/ml intervals from 4.5 mg/ml to 0.5 mg/ml. Aliquots (3-5mls) of these samples are injected from least to most concentrate into the BI-Dn/Dc using DMSO as the solvent reference. The change in refractive index with concentration is then measured directly by the instrument. These samples are then analyzed using the BI-200SM at increments of 5 degrees from 45 to 125. Dn/Dc measurements conclude that cationic high amylose starch is ~0.500 ml/g and Hydrolyzed cationic starches from maize is ~0.862 ml/g. Prior to each run the instrumental conditions were calibrated using toluene at 90 degrees to determine the Rayleigh ratio 'Rq'. Toluene is purchased from EM Scient (Lot#42044208)

In another aspect of the invention, starch of the present invention is cationic. The term "cationic starch" means that the starch is chemically modified to provide a net positive charge in aqueous solution at pH 3. These chemical modifications include, but are not limited to, the addition of amino and/or ammonium group(s) into the starch molecules. Non-limiting examples of these ammonium groups may include substituents such as trimethylhydroxypropyl ammonium chloride, dimethylstearylhydroxypropyl ammonium chloride, or dimethyldodecylhydroxypropyl ammonium chloride. See Solarek, D. B., Cationic Starches in Modified Starches: Properties and Uses, Wurzburg, 0. B., Ed., CRC Press, Inc., Boca Raton, Fla. 1986, pp 113-125.

In one embodiment, the cationic high amylose starch in the present invention may compromise one or more additional chemical modifications. For example, these modifications may include cross-linking, stabilization reactions, phophorylations, hydrolyzations, cross-linking. Stabilization reactions may include alkylation and esterification.

In one embodiment of the present invention, the cationic high amylose starch of the present invention may comprise a particular degree of substitution. As used herein, the "degree of substitution" of cationic high amylose starches is an average measure of the number of hydroxyl groups on each anhydroglucose unit which are derivitised by substituent groups. Since each anhydroglucose unit has three potential hydroxyl groups available for substitution, the maximum possible degree of substitution is 3. The degree of substitution is expressed as the number of moles of substituent groups per mole of anhydroglucose unit, on a molar average basis. In one embodiment of the invention, the cationic high amylose starch comprises a minimum degree of substitution of at least about 0.01, alternatively at least about 0.02, alternatively at least about 0.025, alternatively at least about 0.03, alternatively at least about 0.04, alternatively at least about 0.045. In another embodiment, the cationic high amylose starch comprises a maximum degree of substitution of less than about 0.5, alternatively less than about 0.4, alternatively less than about 0.3, alternatively less than about 0.2, alternatively less than about 0.09, alternatively less than about 0.08. In another embodiment, the cationic high amylose starch comprises a degree of substitution of from about 0.01 to about 0.09, preferably from about 0.04 to about 0.09. A typical method of determining the degree of substitution for cationic substituents is measuring weight percentage (wt %) of bound nitrogen on the basis of total cationic high amylose starch weight per the Kjeldahl analysis as described in *Methods in Carbohydrate Chemistry,* Vol. 4 (Starch), Roy L. Whistler, editor, pp. 47-49. From the Kjeldahl analysis both the Degree of Substitution (DS) and the meq per gram (meq/g) can be calculated for the cationic high amylose starches using the following two equations: (i) DS=(wt % Nitrogen/100 g starch)×(1 mole Nitrogen/14 g Nitrogen)×(162 g glucose/1 mole glucose); and (ii) meq/g=(wt % Nitrogen/100 g starch)×(1 mole Nitrogen/14g Nitrogen)×(1 eq Nitrogen/1 mole Nitrogen)×(1000 mmol/1 mole).

Table 1 demonstrates the relationship, on weight/weight percentage basis, of bound nitrogen to total cationic high amylose starch (wt % Nitrogen) and the degree of substitution (DS) and milliquivalents/gram (meq/g) that can be calculated therefrom.

TABLE 1

| Wt % Nitrogen | DS | meq/g |
|---|---|---|
| 0.09 | 0.01 | 0.06 |
| 0.17 | 0.02 | 0.12 |
| 0.22 | 0.025 | 0.15 |
| 0.26 | 0.03 | 0.19 |
| 0.34 | 0.04 | 0.24 |
| 0.39 | 0.045 | 0.28 |
| 0.69 | 0.08 | 0.49 |
| 0.78 | 0.09 | 0.56 |
| 1.75 | 0.20 | 1.25 |
| 2.60 | 0.30 | 1.86 |
| 3.50 | 0.40 | 2.50 |
| 4.32 | 0.50 | 3.09 |

The source of starch before chemical modification can be chosen from a variety of sources including tubers, legumes, cereal, and grains. Non-limiting examples of this source starch may include corn or maize starch, rice starch, pea starch, barley starch, oat starch, wheat starch, or potato starch. These sources of starch may be used appreciating that they provide high levels of amylose content. At least one source of starch, before chemical modification, for the cationic high amylose starches of the present invention, includes high amylose maize. High amylose maize is distinguishable from common maize, in that these hybridized maizes provide higher levels of amylose. Suitable starches for use in the present compositions may include those commercially-available from National Starch and Chemical Company under the trade names HYLON® V, HYLON® VII, or HYLON® VIII, with the addition of desired cationic substitution.

Another aspect of the present invention provides for a method of making a composition of the present invention comprising the step of heating a source of starch by steaming the source of starch to a temperature of at least 300° C., alternatively at least 320° C., alternatively at least 330° C., alternatively from about 300° C. to about 380° C. In one embodiment, the method further comprises the step of pressurizing the source of starch while heating the source of starch, comprising applying from about 80 pounds per square inch ("psi") to about 100 psi, alternatively about 90 psi to about 100 psi. A suitable piece of equipment to heat and pressure the source of starch is a jet cooker, preferably a starch jet cooker.

Without wishing to be bound by theory, the present invention treats sources of starch to greater temperatures and/or pressure than traditional sources of starch, i.e., non-high amylose starch, because an increased level of energy is required to break the high amylose starch granule structure into its polymeric dispersion. Other steps for preparing sources of starch in a composition of the present invention may include the steps described in U.S. Pat. Pub. No. 2004/0204337 A1. In one embodiment, the heat treated starch is added to a composition that comprises a fabric softening active, and preferably the composition is heated at a temperature between from about 85° C. to about 95° C.

In one embodiment, the compositions of the present invention comprise cationic high amylose starch at a level of from about 0.01% to about 4%, alternatively 0.1% to about 3%, alternatively from about 0.2% to about 2.0%, alternatively from about 0.3% to about 1.5%, by weight of the composition.

In one embodiment of the invention the composition of the present invention is a fabric care composition, alternatively a fabric softening composition, alternatively a rinse-added fabric softening composition. In another embodiment, the composition is free or essentially free of any detersive surfactants. In yet another embodiment, the composition in a single rinse or first rinse fabric softening composition. An example of a first rinse or single rinse composition is described in U.S. Pat. Publ. No. 2003/0060390.

Another aspect of the invention provides for a composition comprising a fabric softening active (hereinafter "FSA"), wherein, for purposes of clarification, the FSA is in addition to the cationic high amylose starch of the present invention. Typical minimum levels of incorporation of the FSA in the present compositions are at least about 1%, alternatively at least about 2%, alternatively at least about 3%, alternatively at least about at least about 5%, alternatively at least about 10%, and alternatively at least about 12%, by weight of the composition. The composition may typical comprise maximum levels of FSA of about less than about 90%, alternatively less than about 40%, alternatively less than about 30%, alternatively less than about 20%, by weight of the composition.

In one embodiment of the invention, the FSA is a quaternary ammonium compound suitable for softening fabric in a rinse step. In one embodiment, the FSA is formed from a reaction product of a fatty acid and an alkanolamines (consistent with terminology below) obtaining mixtures of mono-, di-, and, in one embodiment, triester compounds, in a second embodiment, free or essentially free of a triester compounds. In another embodiment, the FSA comprises one or more softener quaternary ammonium compounds such, but not limited to, as a monoalkylquaternary, ammonium compound, monoester quaternary ammonium compound, a monoamido quaternary ammonium compound, a dialkylquaternary ammonium compound, a diamido quaternary compound, a diester quaternary ammonium compound, or combinations thereof.

In one aspect of the invention, the FSA comprises a diester quaternary ammonium (hereinafter "DQA") compound composition. In certain embodiments of the present invention, the DQA compounds compositions also encompasses a description of diamido FSAs and FSAs with mixed amido and ester linkages as well as the aforementioned diester linkages, all herein referred to as DQA.

A first type of DQA ("DQA (1)") that could be suitable as a FSA in the present invention includes a compound comprising the formula:

{R4-m-N+-[(CH2)n-Y—R1]m}X— wherein each R substituent is either hydrogen, a short chain $C_1$-$C_6$, preferably $C_1$-$C_3$ alkyl or hydroxyalkyl group, e.g., methyl (most preferred), ethyl, propyl, hydroxyethyl, hydroxypropyl, and the like, poly ($C_{2-3}$ alkoxy), preferably polyethoxy, group, benzyl, or mixtures thereof; each m is 2 or 3; each n is from 1 to about 4, preferably 2; each Y is —O—(O)C—, —C(O)—O—, —NR—C(O)—, or —C(O)—NR— and it is acceptable for each Y to be the same or different; the sum of carbons in each $R^1$, plus one when Y is —O—(O)C— or —NR—C(O)—, is $C_{12}$-$C_{22}$, preferably $C_{14}$-$C_{20}$, with each $R^1$ being a hydrocarbyl, or substituted hydrocarbyl group; it is acceptable for $R^1$ to be unsaturated or saturated and branched or linear and preferably it is linear; it is acceptable for each $R^1$ to be the same or different and preferably these are the same; and $X^-$ can be any softener-compatible anion, preferably, chloride, bromide, methylsulfate, ethylsulfate, sulfate, phosphate, and nitrate, more preferably chloride or methyl sulfate. Preferred DQA compounds are typically made by reacting alkanolamines such as MDEA (methyldiethanolamine) and TEA (triethanolamine) with fatty acids. Some materials that typically result from such reactions include N,N-di(acyl-oxyethyl)-N,N-dimethylammonium chloride or N,N-di(acyloxyethyl)-N,N-methylhydroxyethylammonium methylsulfate wherein the acyl group is derived from animal fats, unsaturated, and polyunsaturated, fatty acids, e.g., tallow, hardended tallow, oleic acid, and/or partially hydrogenated fatty acids, derived from vegetable oils and/or partially hydrogenated vegetable oils, such as, canola oil, safflower oil, peanut oil, sunflower oil, corn oil, soybean oil, tall oil, rice bran oil, palm oil, etc. Non-limiting examples of suitable fatty acids are listed in U.S. Pat. No. 5,759,990 at column 4, lines 45-66. In one embodiment the FSA comprises other actives in addition to DQA (1) or DQA. In yet another embodiment, the FSA comprises only DQA (1) or DQA and is free or essentially free of any other quaternary ammonium compounds or other actives. In yet another embodiment, the FSA comprises the precursor amine that is used to produce the DQA.

In another aspect of the invention, the FSA comprises a compound, identified as DTDMAC comprising the formula:

[R4-m-N(+)-R1m]A– wherein each m is 2 or 3, each $R^1$ is a $C_6$-$C_{22}$, preferably $C_{14}$-$C_{20}$, but no more than one being less than about $C_{12}$ and then the other is at least about 16, hydrocarbyl, or substituted hydrocarbyl substituent, preferably $C_{10}$-$C_{20}$ alkyl or alkenyl (unsaturated alkyl, including polyunsaturated alkyl, also referred to sometimes as "alkylene"), most preferably $C_{12}$-$C_{18}$ alkyl or alkenyl, and branch or unbranched. In one embodiment, each R is H or a short chain $C_1$-$C_6$, preferably $C_1$-$C_3$ alkyl or hydroxyalkyl group, e.g., methyl (most preferred), ethyl, propyl, hydroxyethyl, and the like, benzyl, or $(R^2O)_{2-4}H$ where each $R^2$ is a $C_{1-6}$ alkylene group; and $A^-$ is a softener compatible anion, preferably, chloride, bromide, methylsulfate, ethylsulfate, sulfate, phosphate, or nitrate; more preferably chloride or methyl sulfate. Examples of these FSAs include dialkydimethylammonium salts and dialkylenedimethylammonium salts such as ditallowdimethylammonium chloride and ditallowdimethylammonium methylsulfate. Examples of commercially available dialkyl(ene) dimethylammonium salts usable in the present invention are di-hydrogenated tallow dimethyl ammonium chloride and ditallowdimethyl ammonium chloride available from Degussa under the trade names Adogen® 442 and Adogen® 470 respectively. In one embodiment the FSA comprises other actives in addition to DTDMAC. In yet another embodiment, the FSA comprises only compounds of the DTDMAC and is free or essentially free of any other quaternary ammonium compounds or other actives.

In one embodiment, the FSA comprises an FSA described in U.S. Pat. Pub. No. 2004/0204337 A1, published Oct. 14, 2004 to Corona et al., from paragraphs 30-79.

In another embodiment, the FSA is one described in U.S. Pat. Pub. No. 2004/0229769 A1, published Nov. 18, 2005, to Smith et al., on paragraphs 26-31; or U.S. Pat. No. 6,494,920, at column 1, line 51 et seq. detailing an "esterquat" or a quatemized fatty acid triethanolamine ester salt.

In yet another embodiment, the FSA comprises a nonionic FSA, preferably one comprises a sucrose ester. Sucrose ester is composed of a sucrose moiety having one or more of its hydroxyl groups esterified.

Sucrose is a disaccharide having the following formula:

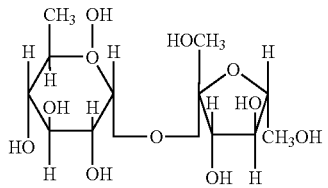

Alternatively, the sucrose molecule can be represented by the formula: $M(OH)_8$, wherein M is the disaccharide backbone and there are total of 8 hydroxyl groups in the molecule.

Thus, sucrose esters can be represented by the following formula:

$$M(OH)_{8-x}(OC(O)R^1)_x$$

wherein x is the hydroxyl groups that are esterified and (8−x) is the hydroxyl groups that remain unchanged; x is an integer selected from 1 to 8, or from 2 to 8, or from 3 to 8, or from 4 to 8; and $R^1$ moieties are independently selected from $C_1$-$C_{22}$ alkyl or $C_1$-$C_{30}$ alkoxy, linear or branched, cyclic or acyclic, saturated or unsaturated, substituted or unsubstituted.

In one embodiment, the $R^1$ moieties comprise linear alkyl or alkoxy moieties having independently selected and varying chain length. For example, $R^1$ may comprise a mixture of linear alkyl or alkoxy moieties wherein greater than about 20% of the linear chains are $C_{18}$, or greater than about 50% of the linear chains are $C_{18}$, or greater than about 80% of the linear chains are $C_{18}$.

In another embodiment, the $R^1$ moieties comprise a mixture of saturate and unsaturated alkyl or alkoxy moieties; the degree of unsaturation can be measured by "Iodine Value" (hereinafter referred as "IV", as measured by the standard AOCS method). The IV of the sucrose esters suitable for use herein ranges from about 1 to about 150, or from about 2 to about 100, or from about 5 to about 85. The $R^1$ moieties may be hydrogenated to reduce the degree of unsaturation.

In a further embodiment, the unsaturated $R^1$ moieties may comprise a mixture of "cis" and "trans" forms about the unsaturated sites. The "cis"/"trans" ratios may range from about 1:1 to about 50:1, or from about 2:1 to about 40:1, or from about 3:1 to about 30:1, or from about 4:1 to about 20:1.

In one embodiment, the composition of the present invention may comprise electrolytes and phase stabilizing polymers as disclosed in U.S. Publication No 2004/0204337 A1.

In another embodiment, the composition of the present invention may comprise any one or more adjunct ingredients. In yet another embodiment, the composition of the present invention may be free or essentially free of any one or more adjunct ingredients. The term "adjunct ingredients" may include: a perfume, dispersing agent, stabilizer, pH control agent, metal ion control agent, colorant, brightener, dye, odor control agent, pro-perfume, cyclodextrin, solvent, soil release polymer, preservative, antimicrobial agent, chlorine scavenger, enzyme, anti-shrinkage agent, fabric crisping agent, spotting agent, anti-oxidant, anti-corrosion agent, bodying agent, drape and form control agent, smoothness agent, static control agent, wrinkle control agent, sanitization agent, disinfecting agent, germ control agent, mold control agent, mildew control agent, antiviral agent, anti-microbial, drying agent, stain resistance agent, soil release agent, malodor control agent, fabric refreshing agent, chlorine bleach odor control agent, dye fixative, dye transfer inhibitor, color maintenance agent, color restoration/rejuvenation agent, anti-fading agent, whiteness enhancer, anti-abrasion agent, wear resistance agent, fabric integrity agent, anti-wear agent, and rinse aid, UV protection agent, sun fade inhibitor, insect repellent, anti-allergenic agent, enzyme, flame retardant, water proofing agent, fabric comfort agent, water conditioning agent, shrinkage resistance agent, stretch resistance agent, and combinations thereof. In one embodiment, the composition comprises an adjunct ingredient up to about 2% by weight of the composition.

In one embodiment, the pH of the composition may comprise a pH of from about 2 to about 5, preferably from about 2 to about 4.5, and more preferably from about 2.5 to about 4. In another embodiment, the composition comprises a neutral pH, alternatively from about 5 to about 9, from about 6 to about 8, alternatively from about 7.

In one embodiment, the composition of the present invention further comprises a perfume microcapsule. Suitable perfume microcapsules may include those described in the following references: US 2003-215417 A1; US 2003-216488 A1; US 2003-158344 A1; US 2003-165692 A1; US 2004-071742 A1; US 2004-071746 A1; US 2004-072719 A1; US 2004-072720 A1; EP 1393706 A1; US 2003-203829 A1; US 2003-195133 A1; US 2004-087477 A1; US 2004-0106536 A1; U.S. Pat. Nos. 6,645,479; 6,200,949; 4,882,220; 4,917,920; 4,514,461; US RE 32713; U.S. Pat. No. 4,234,627. In another embodiment, the perfume microcapsule comprises a friable microcapsule (e.g., aminoplast copolymer comprising perfume microcapsule, esp. melamine-formaldehyde or urea-formaldehyde). In another embodiment, the perfume microcapsule comprises a moisture-activated microcapsule (e.g., cyclodextrin comprising perfume microcapsule). In yet another embodiment, the starches of the present invention may by used for structuring the liquid that is used to suspend perfume microcapsules. Without wishing to be bound theory, this structuring effect may be attributed to the increased amylose content in the starch polymers of the present invention.

In one aspect of the invention, a method of softening or treating a fabric is provided. In one embodiment, the method comprises the step of obtaining a composition of the present invention. In another embodiment, the method comprises the step of administering a composition of the present invention to a rinse cycle of an automatic laundry machine or a hand washing laundry rinse basin. The term "administering" means causing the composition to be delivered to a rinse bath solution. Examples of administering include, for example, dispensing the composition in an automatic fabric softener dispenser that is integral to the laundry washing machine whereby the dispenser dispenses the composition at the appropriate time during the laundry washing process, e.g., last rinse cycle. Another example is dispensing the composition in a device, such a DOWNY BALL, wherein the device will dispense the composition at the appropriate time during the laundry washing process. In another embodiment, a composition of the present invention is dosed in a first rinse bath solution or a dosed in a single rinse bath solution. This is particularly convenient in a hand washing context. See e.g., U.S. Pat. Appl. No. 2003-0060390 A1. In one embodiment, a method of softening a fabric in a manual rinse processes comprising the steps: (a) adding a fabric softening composition of the present invention to a first rinse bath solution; (b) rinsing manually the fabric in the first rinse bath solution; (c) optionally the fabric softening composition comprises a suds suppressor. A method of reducing the volume of water consumed in a manual rinse process comprises the aforementioned step is also provided.

Without wishing to be bound by theory, it is believed that starch polymers (amylose/amylopectin) self assemble to make films and nanoparticles. The formation of film and nanoparticles can be impacted by electrolytes and/or the presence of fatty acid/surfactants. Maize Starch is observed to make films (thickness 3-10 mn) and nanoparticles (10-100 nm). It is believed that increasing amylose content in starch increases the amount of nanoparticles formed on a fabric surface. Conversely, the lower the amylose content in the starch results in fewer nanoparticles formed. However, the addition of electrolytes (e.g., $CaCl_2$) appears to enhance the nanoparticles formation. In addition to improving deposition efficiency of benefit agents (e.g., surfactant, FSA etc.), it is the formation of these nanoparticles and films on the surface of fiber/fabric that is likely one of the mechanisms of functionality for the starches of the present invention that provide the enhanced fabric feel/softening benefits realized by the present invention.

EXAMPLES

The following are non-limiting examples of the fabric care compositions of the present invention.

| | EXAMPLE | | | | | | | | |
|---|---|---|---|---|---|---|---|---|---|
| (% wt) | I | II | III | IV | V | VI | VII | VIII | IX |
| FSA[a] | 12 | 14 | 14 | 14 | 16.1 | 5 | 5 | — | — |
| FSA[b] | — | — | — | — | — | — | — | 3.00 | — |
| FSA[c] | — | — | — | — | — | — | — | — | 6.5 |
| Ethanol | 1.95 | 2.28 | 2.28 | 2.28 | 2.68 | 0.81 | 0.81 | — | — |
| Isopropyl Alcohol | — | — | — | — | — | — | — | 0.33 | 1.22 |
| Starch[d] | 1.25 | 1.25 | 2.00 | 0.75 | 1.44 | 0.42 | 0.25 | 0.5 | 0.70 |
| Perfume | 1.50 | 1.50 | 1.50 | 1.50 | 1.50 | 0.60 | 0.60 | 1.30 | 0.8-1.5 |
| Phase Stabilizing Polymer[e] | 0.25 | 0.142 | 0.25 | 0.25 | 0.25 | — | — | — | — |
| Suds Suppressor[f] | — | — | — | — | — | — | — | — | 0.1 |
| Calcium Chloride | 0.25 | 0.45 | 0.55 | 0.350 | 0.545 | — | — | — | 0.1-0.15 |
| DTPA[g] | 0.005 | 0.005 | 0.005 | 0.005 | 0.007 | 0.002 | 0.002 | 0.20 | — |
| Preservative (ppm)[h] | 5 | 5 | 5 | 5 | 5 | 5 | 5 | — | 250[i] |
| Antifoam[j] | 0.015 | 0.011 | 0.011 | 0.011 | 0.011 | 0.015 | 0.015 | — | — |
| Dye (ppm) | 40 | 40 | 40 | 40 | 40 | 30 | 30 | 11 | 30-300 |
| Ammonium Chloride | 0.10 | 0.10 | 0.10 | 0.10 | 0.115 | — | — | — | — |
| HCl | 0.010 | 0.010 | 0.010 | 0.010 | 0.010 | 0.011 | 0.011 | 0.016 | 0.025 |
| Deionized Water | Balance | Balance | Balance | Balance | Balance | Balance | Balance | Balance | Balance |

[a]N,N-di(tallowoyloxyethyl)-N,N-dimethylammonium chloride.
[b]Methyl bis(tallow amidoethyl)2-hydroxyethyl ammonium methyl sulfate.
[c]Reaction product of Fatty acid with Methyldiethanolamine in a molar ratio 1.5:1, quaternized with Methylchloride, resulting in a 1:1 molar mixture of N,N-bis(stearoyl-oxy-ethyl) N,N-dimethyl ammonium chloride and N-(stearoyl-oxy-ethyl) N,-hydroxyethyl N,N dimethyl ammonium chloride.
[d]Cationic high amylose maize starch available from National Starch under the trade name HYLON VII ®.
[e]Copolymer of ethylene oxide and terephthalate having the formula described in U.S. Pat. No. 5,574,179 at col. 15, lines 1-5, wherein each X is methyl, each n is 40, u is 4, each R1 is essentially 1,4-phenylene moieties, each R2 is essentially ethylene, 1,2-propylene moieties, or mixtures thereof.
[f]SE39 from Wacker
[g]Diethylenetriaminepentaacetic acid.
[h]KATHON ® CG available from Rohm and Haas Co. "PPM" is "parts per million."
[i]Gluteraldehyde
[j]Silicone antifoam agent available from Dow Corning Corp. under the trade name DC2310.

It should be understood that every maximum numerical limitation given throughout this specification includes every lower numerical limitation, as if such lower numerical limitations were expressly written herein. Every minimum numerical limitation given throughout this specification includes every higher numerical limitation, as if such higher numerical limitations were expressly written herein. Every numerical range given throughout this specification includes every narrower numerical range that falls within such broader numerical range, as if such narrower numerical ranges were all expressly written herein.

All parts, ratios, and percentages herein, in the Specification, Examples, and claims, are by weight and all numerical limits are used with the normal degree of accuracy afforded by the art, unless otherwise specified.

All documents cited in the Detailed Description of the Invention are, in relevant part, incorporated herein by reference; the citation of any document is not to be construed as an admission that it is prior art with respect to the present invention.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A fabric care composition comprising:

(a) a cationic starch, wherein the cationic starch comprises from 51% to about 95% amylose content by weight of the cationic starch; and wherein cationic starch comprises an average molecular weight of from 20,000,000 Daltons to about 60,000,000 Daltons; and (b) from about 2% to about 40% of a quaternary ammonium compound by weight of the composition.

2. The composition of claim 1, wherein the degree of substitution is from 0.01 to 0.09.

3. The composition of claim 2, wherein the degree of substitution is from 0.04 to 0.09.

4. The composition of claim 3, wherein the cationic starch comprises the average molecular weight of from 25,000,000 Daltons to about 60,000,000 Daltons.

5. The composition of claim 4, wherein the cationic starch comprises the average molecular weight of from 30,000,000 Daltons to about 60,000,000 Daltons.

6. The composition of claim 1 where the composition comprises from about 0.01% to about 4% of the cationic starch by weight of the composition; and wherein the cationic starch comprises the average molecular weight of from 35,000,000 Daltons to about 60,000,000 Daltons.

7. The composition of claim 1, wherein the cationic starch comprises from 75% to about 95% amylose content by weight of the cationic starch.

8. The composition of claim 1, wherein the composition further comprises from about 2% to about 30% of the quaternary ammonium compound by weight of the composition.

9. The composition of claim 8, where the composition comprises from about 0.01% to about 4% of the cationic starch, by weight of the composition.

10. The composition of claim 9, wherein the degree of substitution is from 0.01 to 0.09.

11. The composition of claim 10, wherein the degree of substitution is from 0.04 to 0.09.

12. The composition of claim 9, wherein the fabric care composition is a fabric softening composition.

13. The composition of claim 1, wherein the cationic starch comprises from 75% to about 95% amylose content by weight of the cationic starch.

14. A kit comprising a composition according to claim 1.

15. A fabric care composition comprising:

(a) a cationic starch, wherein the cationic starch comprises from 51% to about 95% amylose content by weight of the cationic starch; and wherein cationic starch comprises an average molecular weight of at least 30,000,000 Daltons to about 60,000,000 Daltons; and (b) from about 2% to about 40% of a quaternary ammonium compound by weight of the composition.

16. A fabric care composition comprising:

(a) a cationic starch, wherein the cationic starch comprises from 75% to about 95% amylose content by weight of the cationic starch; and wherein cationic starch comprises an average molecular weight of at least 35,000,000 Daltons to about 60,000,000 Daltons; and (b) from about 2% to about 40% of a quaternary ammonium compound by weight of the composition.

* * * * *